US005382101A

United States Patent [19]

Iguchi

[11] Patent Number: 5,382,101

[45] Date of Patent: Jan. 17, 1995

[54] PRINTER DRIVING APPARATUS FOR LINE PRINTER

[75] Inventor: Kesayoshi Iguchi, Fujisawa, Japan

[73] Assignee: Matsushita Electric Industrial Co., Ltd., Osaka, Japan

[21] Appl. No.: 34,643

[22] Filed: Mar. 22, 1993

Related U.S. Application Data

[63] Continuation of Ser. No. 743,106, Aug. 9, 1991, abandoned.

[30] Foreign Application Priority Data

Aug. 20, 1990 [JP] Japan ..... 2-219227

[51] Int. Cl.[6] ..... B41J 2/30

[52] U.S. Cl. ..... 400/124.03; 400/120.1

[58] Field of Search ..... 400/54, 120, 121; 346/76 PH

[56] References Cited

U.S. PATENT DOCUMENTS 4,623,899 11/1986 Sakakibara ..... 400/54
4,650,348 3/1987 Kaneko ..... 400/54
4,653,940 3/1987 Katsukawa ..... 400/54
4,765,763 8/1988 Ishikawa ..... 400/54

FOREIGN PATENT DOCUMENTS 71174 4/1983 Japan ..... 400/54
157881 8/1985 Japan ..... 400/54

*Primary Examiner*—David A. Wiecking
*Assistant Examiner*—Steven S. Kelley
*Attorney, Agent, or Firm*—Stevens, Davis, Miller & Mosher

[57] ABSTRACT

A printer driving apparatus for a line printer comprises: a measuring circuit to measure the number of print dots; and a driving circuit which can change drive timings of dots of a print head in correspondence to a print ratio in each print cycle. When the number of print dots is small, an interval between strobes is narrowed. When it is large, an interval between strobes is widened. Thus, a high-speed printing can be performed in the case of using the power source of the same capacity. When a high-speed printing is not required, the capacity of the power source can be reduced.

2 Claims, 6 Drawing Sheets

PRINTER DRIVING APPARATUS FOR LINE PRINTER

This application is a continuation of application Ser. No. 07/743,106, filed Aug. 9, 1991 (abandoned).

BACKGROUND OF THE INVENTION

The present invention relates to a printer driving apparatus which is used for a line printer.

Hitherto, as a line printer of the dot matrix type, a construction such that each character is divided into dots and a print head is driven by a plurality of print cycles to thereby print has been known. The above conventional printer driving apparatus will now be described hereinbelow with reference to the drawings.

FIG. 1 is a circuit diagram showing a prior printer driving apparatus. FIG. 2 is an explanatory diagram showing print timings in the above prior art. FIG. 3 is an explanatory diagram showing a print example. FIG. 4 is an explanatory diagram showing an example of data stored in a print buffer in the prior art.

In FIG. 1, reference numeral 51 denotes a print head; 52 a print buffer to store print data; 53 a driving circuit to drive dots of the print head 51 in correspondence to the data in the print buffer 52 and strobe signals I, II, III, and IV; 54 a paper feed motor; 55 a driving circuit to drive the paper feed motor 54; and 56 a power source.

The operation in the above construction will now be described hereinbelow.

It is now assumed that numbers "1234" of four digits shown in the print example of FIG. 3 are printed. Each of the numbers 4, 3, 2, and 1 of each digits is divided into 72 ($=8\times9$) dots and is printed by driving the print head 51 of 32 dots by the driving circuit 53 by total nine print cycles of the first to ninth print cycles. As shown in FIG. 4, the data to be printed every print cycle have been stored in the print buffer 52. A power source of a large capacity is needed to drive the 32 dots of the print head 51 in a lump in correspondence to total 32 dots of each print cycle of the characters of four digits. Therefore, as shown in FIGS. 1 and 2, by making the driving circuit 53 operative on the basis of the data in the print buffer 52 in correspondence to the strobe signals I to IV, a current is supplied to the print head 51. In the first print cycle, the 32 dots are divided into four groups of the 1st to 8th dots, the 9th to 16th dots, the 17th to 24th dots, and the 25th to 32nd dots for each of the numbers 4, 3, 2, and 1 of each digit. Those dots are driven every group and printed.

To print the next dots after completion of the printing, the motor 54 is driven by the driving circuit 55, thereby feeding a print paper. In a manner similar to the above, in each of the second to ninth print cycles, the 32 dots of the print head 51 are divided into four groups every number of each digit and printed.

As mentioned above, in the printer driving apparatus of the conventional example, the power source load is reduced into by a factor of 4, and the printing is executed in a predetermined printing time.

However, in the driving timings of the conventional example, a division ratio of the dots of the print head 51 in each print cycle is always constant. Therefore, the power source capacity such that all dots can be printed in one print cycle is needed and the power source is expensive. There is also a problem such that the printing time is constant or the like.

SUMMARY OF THE INVENTION

The invention intends to solve the conventional problems as mentioned above and it is an object of the invention to provide a printer driving apparatus in which a print period can be changed in accordance with the number of print dots in each print cycle and, therefore, in the case of using a power source of the same capacity, a high-speed printing can be performed and, on the other hand, in the case where a high-speed printing is not required, the capacity of the power source can be reduced.

To accomplish the above object, the invention comprises: measuring means for measuring the number of print dots; and driving means which can change drive timings of dots of a print head in correspondence to a print ratio in each print cycle.

According to the invention, therefore, the number of print dots is measured and the drive timings of the dots of the print head are changed in correspondence to the print ratio in each print cycle by the driving means on the basis of the result of the measurement. When the number of print dots is small, an interval between strobes can be narrowed. When the number of print dots is large, an interval between strobes can be widened.

DESCRIPTION OF THE PREFERRED EMBODIMENT

An embodiment of the invention will be described hereinbelow with reference to the drawings.

Figure 5:
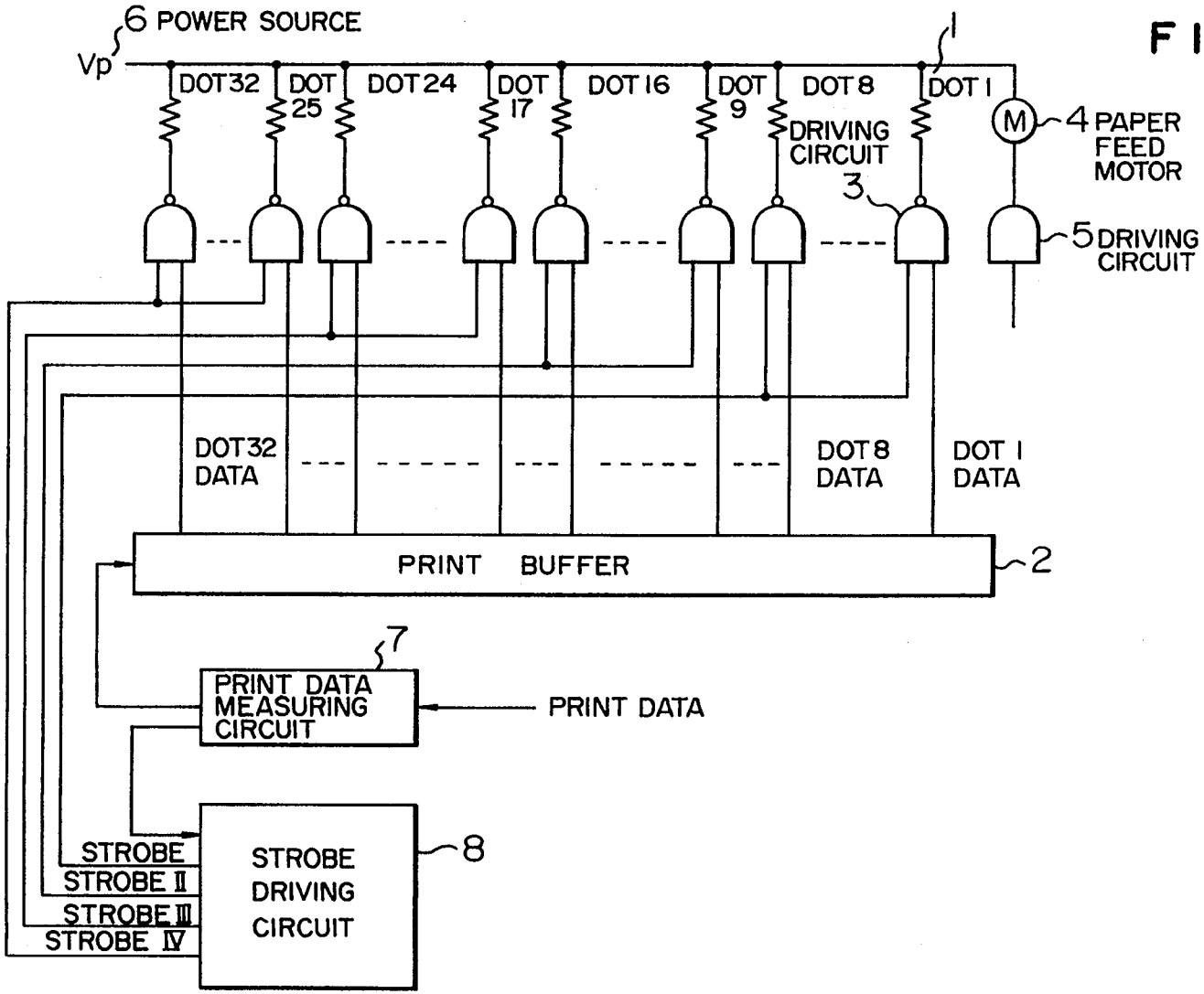
FIG. 5 is a circuit diagram showing a printer driving apparatus in an embodiment of the invention.
Figure 6:
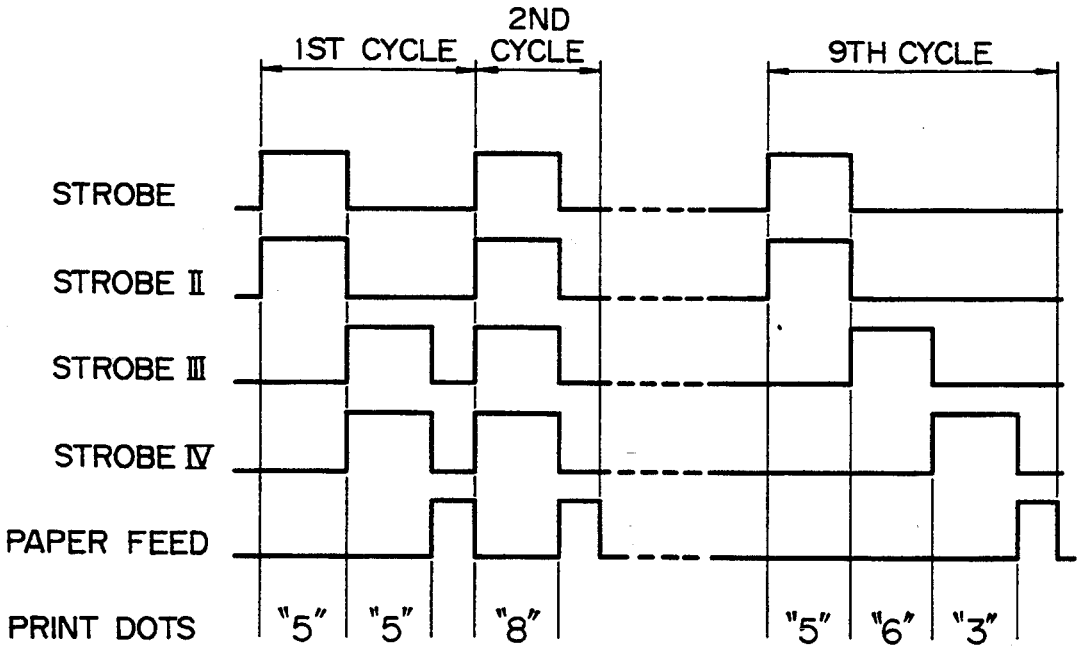
FIGS. 6 and 7 are explanatory diagrams showing examples of print timings in the embodiment, respectively.
Figure 7:
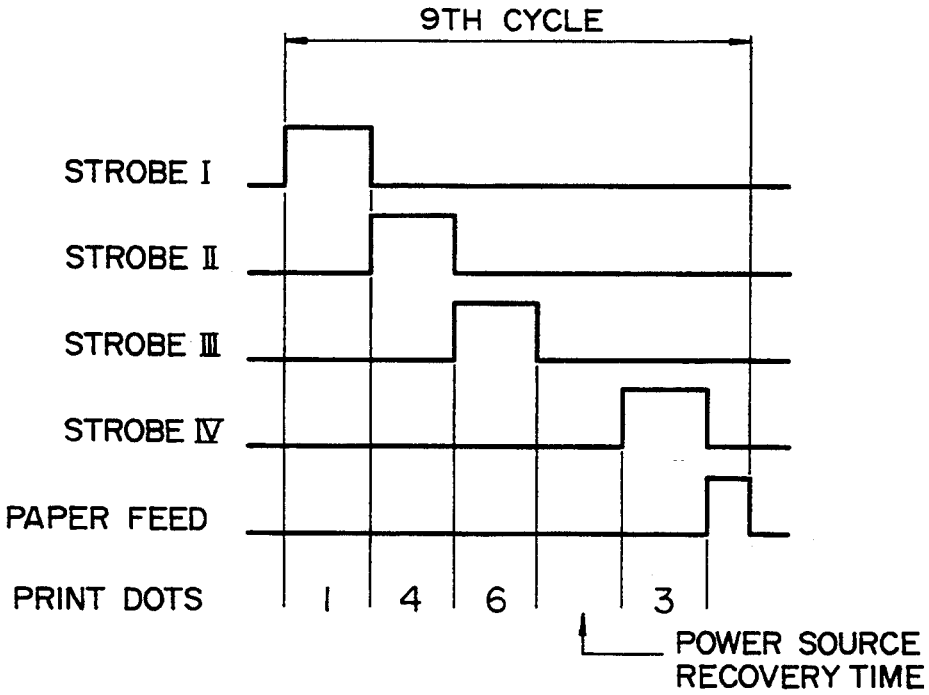
Figure 8:
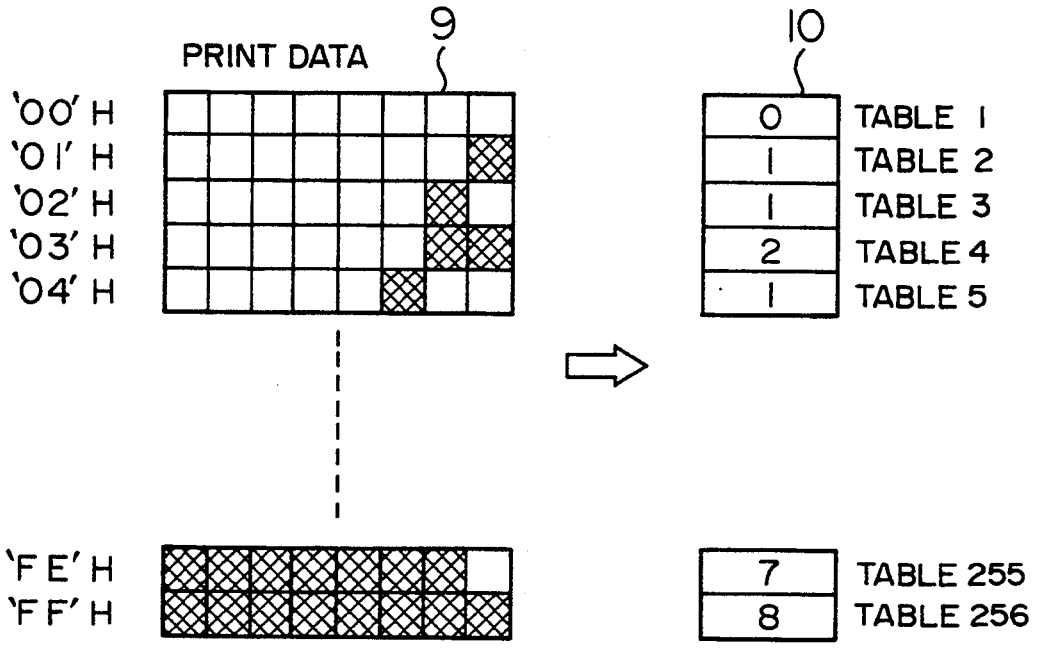
FIG. 8 is an explanatory diagram showing an example of a conversion table of print dots in the embodiment.

FIG. 5 is a circuit diagram showing a construction of a printer driving apparatus in an embodiment of the invention. FIGS. 6 and 7 are explanatory diagrams showing examples of print timings in the embodiment, respectively. FIG. 8 is an explanatory diagram showing an example of a conversion table of print dots in the embodiment.

In FIG. 5, reference numeral 1 denotes a print head; 2 a print buffer to store print data; 3 a driving circuit to drive dots of 1 to 32 of the print head 1 in correspondence to the data in the print buffer 2 and the strobe signals I, II, III, and IV; 4 a paper feed motor; 5 a driving circuit to drive the paper feed motor 4; 6 a power source; 7 a measuring circuit to count the number of dots of the print data which is sent to a print buffer 2; and 8 a driving circuit to variably change the strobe signals I to IV on the basis of a count value of the measuring circuit 7. To count the number of print dots by the measuring circuit 7, it is necessary to judge whether each dot is ON or OFF. It takes a long processing time to judge every dot and an adverse influence is exerted on the print speed. Therefore, as shown in FIG. 8, a table 10 corresponding to print data 9 is referred every digit and the total number of dots is obtained by the sum of the table values, thereby enabling the high processing speed to be realized.

The operation in the above construction will now be described hereinbelow.

Figure 1:
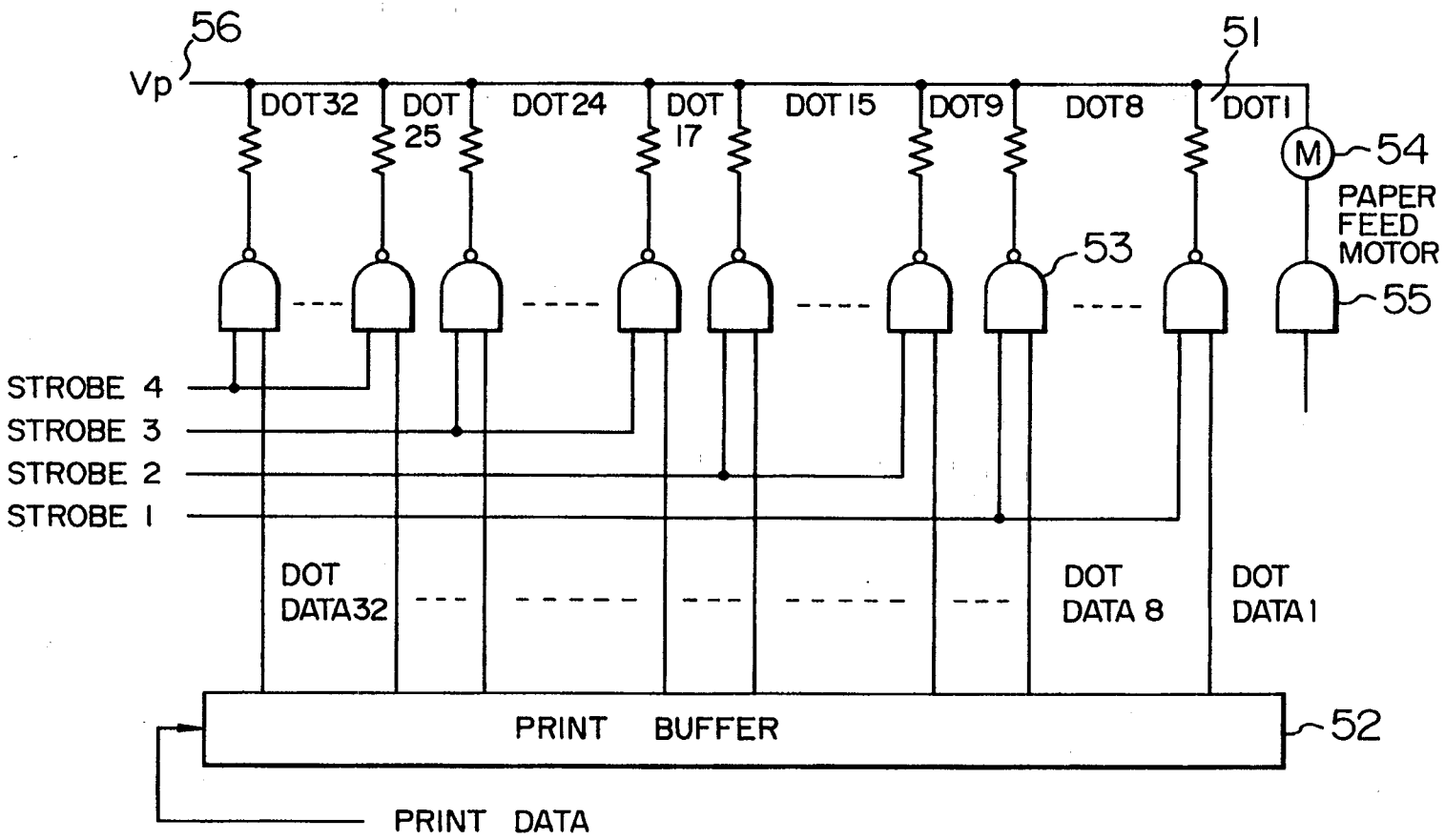
FIG. 1 PRIOR ART
FIG. 1 is a circuit diagram showing a conventional printer driving apparatus.
Figure 2:
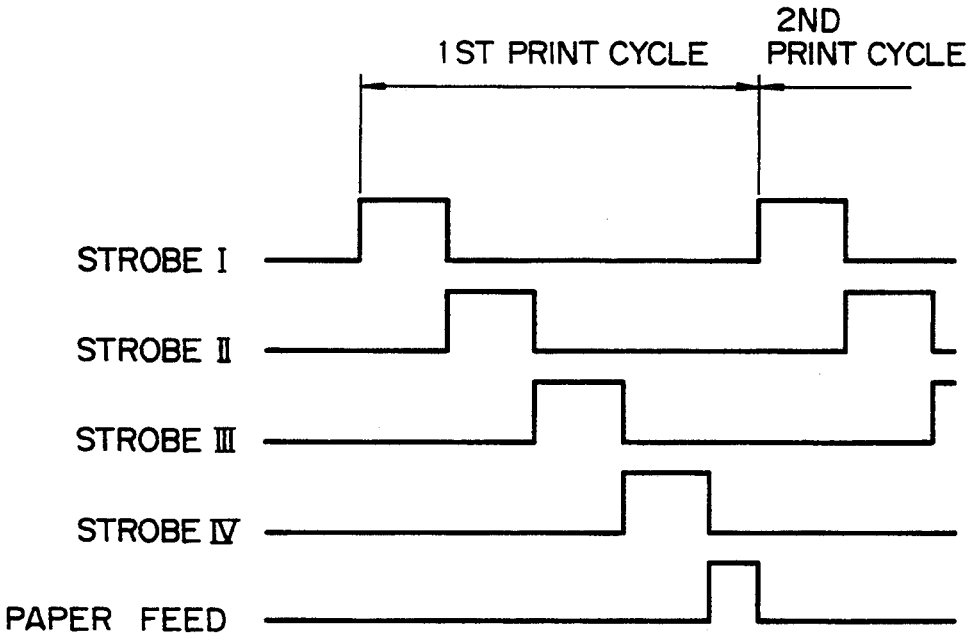
FIG. 2 PRIOR ART
FIG. 2 is an explanatory diagram showing print timings of the above conventional example.
Figure 3:
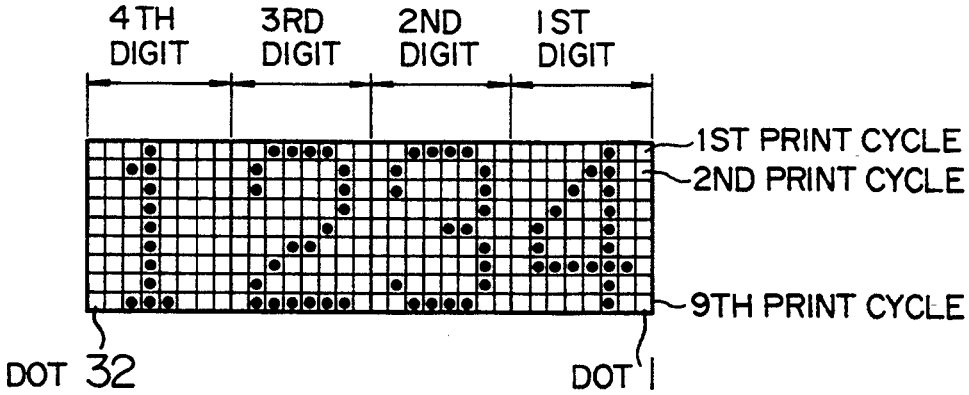
FIG. 3 PRIOR ART
FIG. 3 is an explanatory diagram showing a print example.
Figure 4:
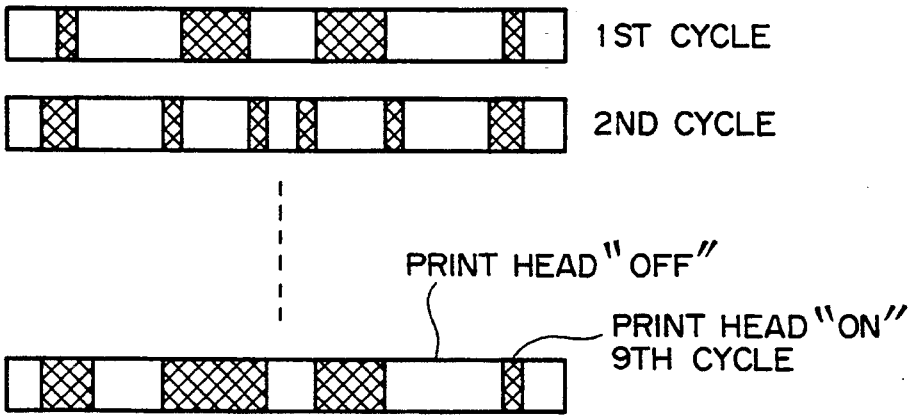
FIG. 4 PRIOR ART
FIG. 4 is an explanatory diagram showing an example of data stored in a print buffer in the conventional example.

In a manner similar to the conventional example, it is now assumed that numbers "1234" of four digits as shown in the print example of FIG. 3 are printed. Each of the numbers 4, 3, 2, and 1 of the respective digits is divided into 72 ($=8\times9$) dots and is printed by driving the print head 1 of 32 dots by the driving circuit 3 in total nine print cycles of the first to ninth print cycles.

In each print cycle of the numbers of four digits, the 32 dots of the print head 1 are divided into four groups of the 1st to 8th dots, the 9th to 16th dots, the 17th to 24th dots, and the 25th to 32nd dots every number of each digit and are driven, thereby executing the printing. Examples of print timings at the above time will be described with reference to FIG. 6.

In order to divide 32 dots into four groups and print, the power source 6 is set so as to have a capacity such that eight dots can be simultaneously continuously printed. The number of dots of the number of each digit in the first print cycle is determined by the print data measuring circuit 7. The numbers of print dots in the first print cycle are equal to 1 for the number 4 of the first digit, 4 for the number 3 of the second digit, 4 for the number 2 of the third digit, and 1 for the number 1 of the fourth digit. The total number of dots of the number 4 of the first digit and the number 3 of the second digit is equal to 5. The total number of dots of the number 2 of the third digit and the number 1 of the fourth digit is equal to 5. Those total numbers are smaller than a predetermined value of the power source 6. Therefore, on the basis of the result of the print data measuring circuit 7, the strobe driving circuit 8 first simultaneously sends the strobe signals I and II and makes the driving circuit 3 operative in correspondence to the data stored in the print buffer 2 and also simultaneously drives the dots 1 to 8 and the dots 9 to 15 of the print head 1, thereby simultaneously printing the first and second digits. Subsequently, the strobe driving circuit 8 simultaneously sends the strobe signals III and IV and makes the driving circuit 3 corresponding to the data stored in the print buffer 2 operative and simultaneously drives the dots 16 to 24 and the dots 25 to 32 of the print head 1, thereby simultaneously printing the third and fourth digits. The number of dots of the number of the respective digits in the second print cycle are similarly measured by the print data measuring circuit 7. In this case, the total number of dots of the number 4 of the first digit, the number 3 of the second digit, the number 2 of the third digit, and the number 1 of the fourth digit is equal to 8 and is within the predetermined value of the power source 6. Therefore, on the basis of the result of the print data measuring circuit 7, the strobe driving circuit 8 simultaneously sends the strobe signals I to IV and makes the driving circuit 3 operative in correspondence to the data stored in the print buffer 2 and simultaneously drives the dots 1 to 32 of the print head 1, thereby simultaneously driving the first to fourth digits. As mentioned above, the dots of the respective digits are sequentially printed in each of the third to ninth print cycles. In the last ninth print cycle as well, the number of dots of the number of the respective digits are similarly determined by the print data measuring circuit 7. In the above case, the total number of dots of the number 4 of the first digit and the number 3 of the second digit is equal to 5 and is smaller than the predetermined value of the power source 6. Therefore, in a manner similar to the above, the dots of the first and second digits are simultaneously printed. The total number of dots of the number 2 of the third digit and the number 1 of the first digit is equal to 9 and is larger than the predetermined value of the power source 6. Therefore, the dots of the third and fourth digits are independently printed in a manner similar to the above.

According to the printing method of the embodiment, since a plurality of digits are simultaneously printed in a range of the predetermined value of the power source 6, namely, a range of the capacity such that the dots can be simultaneously printed, the dots can be printed at a high speed by the power source of the same capacity.

Another example of the print timings will now be described with reference to FIG. 7. In the embodiment, to reduce the power source capacity, the number of dots which can be simultaneously printed is set to, for example, 4 which is the half of the above value. The numbers of dots of the numbers of the respective digits in each print cycle are measured by the print data measuring circuit 7. On the basis of the result of the measurement, the strobe driving circuit 8 sends the strobe signals I to IV, thereby making the driving circuit 3 corresponding to the data in the print buffer 2 operative and driving the corresponding dots of the print head 1 and printing. However, if the dots of the number which is equal to or larger than the predetermined value have been printed, a timer to wait for the recovery of the power source is activated, thereby executing a control to delay the next printing operation. For instance, the ninth print cycle of the print example shown in FIG. 3 will now be described. First, the first digit is printed by the strobe signal I, the second digit is printed by the strobe signal II, and the third digit is subsequently printed by the strobe signal III. At this time, the numbers of dots of the first and second digits are respectively equal to 1 and 4 and are smaller than the predetermined value. Therefore, the first to third digits are continuously printed. However, since the number of dots of the third digit is equal to 6 and is larger than the predetermined value, the apparatus waits for the recovery of the power source 6 and the fourth digit is printed by the strobe signal IV.

As mentioned above, according to the printing method of the embodiment, by reducing the print speed, the printing can be performed by a cheap power source.

As mentioned above, according to the invention, the number of print dots is measured, the drive timing of the dots of the print head, that is, the print period is changed by the driving means on the basis of the result of the measurement in correspondence to the print ratio in each print cycle. When the number of print dots is small, the interval between strobes can be narrowed. When the number of print dots is large, the interval between strobes can be widened. Therefore, in the case of using a power source of the same capacity, a high-speed printing can be performed. On the contrary, when a high-speed printing is not required, the capacity of the power source can be reduced.

I claim:

1. A line printer driving apparatus, comprising:

a power source;

a plurality of print heads, each of which is provided for a print dot;

a strobe signal driving circuit;

a plurality of driving means for driving the print heads, said driving means being connected to said power source and said print heads and being divided into a plurality of groups, each of said plurality of groups corresponding to a character to be printed, the driving means for each said character to be printed being actuated simultaneously by the power source in response to application of a strobe signal by said strobe signal driving circuit to said driving means for each said character to be printed;

measuring means for measuring a number of dots to be printed; and said strobe signal driving circuit being actuated to generate said strobe signal in response to said number of dots measured by said measuring means so that an actuated total number of said print heads at one time does not exceed a predetermined number, thereby to determine a number of said plurality of groups to be actuated simultaneously.

2. A line printer driving apparatus according to claim 1, wherein said measuring means comprises a table showing all possible combinations of the print dots in one of the groups and the corresponding number of print dots, and wherein said measuring means measures the number of dots to be printed by comparing a configuration of dots to be printed in a group with a value in said table.

* * * * *